US007963202B1

(12) United States Patent
Becker et al.

(10) Patent No.: US 7,963,202 B1
(45) Date of Patent: Jun. 21, 2011

(54) SUPERALLOY MORTAR TUBE

(75) Inventors: Richard F. Becker, Gloversville, NY (US); Mark D. Witherell, Wynantskill, NY (US); Jose Santiago, Dover, NJ (US); George E. Hathaway, IV, Sprakers, NY (US); Ramon Espinosa, Hasbrouck Heights, NJ (US); Steve Tauscher, Schuylerville, NY (US)

(73) Assignee: The United States of America as represented by the Secretary of the Army, Washington, DC (US)

( * ) Notice: Subject to any disclaimer, the term of this patent is extended or adjusted under 35 U.S.C. 154(b) by 586 days.

(21) Appl. No.: 12/099,948

(22) Filed: Apr. 9, 2008

Related U.S. Application Data

(63) Continuation-in-part of application No. 11/162,745, filed on Sep. 21, 2005, now abandoned.

(51) Int. Cl.
*F41A 21/00* (2006.01)

(52) U.S. Cl. ..... 89/14.05; 89/14.7; 89/1.82; 42/76.01; 42/76.1

(58) Field of Classification Search ..... 89/14.05–14.8, 89/1.82; 42/76–76.1
See application file for complete search history.

(56) References Cited

U.S. PATENT DOCUMENTS 1,346,188 A * 7/1920 Fahrenwald ..... 42/76.02
1,365,987 A * 1/1921 Hadfield et al. ..... 89/14.7
1,384,718 A * 7/1921 Guy ..... 89/14.7
1,553,825 A * 9/1925 Langenberg ..... 89/14.7
2,541,114 A * 2/1951 Somes ..... 89/14.05
2,541,116 A * 2/1951 Somes ..... 89/14.05
2,876,095 A * 3/1959 Dickerson ..... 420/83
2,990,342 A * 6/1961 Sullivan ..... 205/131
3,516,326 A * 6/1970 Donner ..... 89/14.3
3,892,163 A * 7/1975 Asikainen ..... 89/37.05
4,146,077 A * 3/1979 Klein et al. ..... 164/452
4,198,897 A * 4/1980 Lipp et al. ..... 89/13.05
4,417,459 A * 11/1983 Tomita ..... 72/56
4,571,969 A * 2/1986 Tomita ..... 72/56
4,646,615 A * 3/1987 Gladstone et al. ..... 89/15
4,669,212 A * 6/1987 Jackson et al. ..... 42/76.02
4,747,225 A * 5/1988 Gstettner et al. ..... 42/76.02
4,756,677 A * 7/1988 Hribernik et al. ..... 419/8
5,160,802 A * 11/1992 Moscrip ..... 89/16
5,305,679 A * 4/1994 Begneu ..... 89/26
5,341,719 A * 8/1994 Bullis et al. ..... 89/16
5,429,032 A * 7/1995 Cytron ..... 89/37.05
5,531,150 A * 7/1996 Gegaregian et al. ..... 89/15

(Continued)

OTHER PUBLICATIONS

Gourley, Scott, Mortar Technology, Special Operations Technology, 2008. http://www.special-operations-technology.com/sotech-home/176-sotech-2008-volume-5-issue-4/1640-mortar-technology.html.*

(Continued)

*Primary Examiner* — Michelle Clement
(74) *Attorney, Agent, or Firm* — John F Moran

(57) ABSTRACT

A finless mortar tube made of a superalloy includes, seriatim, a breech end, a beginning taper point, an ending taper point, a lower clamp region, an upper clamp region, and a muzzle end. The nominal wall thickness of the tube is constant from forward of the breech end to the beginning taper point and the nominal wall thickness of the tube decreases from the beginning taper point to the ending taper point. The mortar tube is capable of a substantial increase in the rate of fire compared to conventional mortar tubes.

33 Claims, 4 Drawing Sheets

U.S. PATENT DOCUMENTS

| | | | | |
|---|---|---|---|---|
| 5,677,507 | A * | 10/1997 | Becker et al. | 89/47 |
| 5,856,631 | A * | 1/1999 | Julien | 89/16 |
| 5,928,799 | A * | 7/1999 | Sherman et al. | 428/655 |
| 5,935,351 | A * | 8/1999 | Sherman et al. | 148/519 |
| 6,059,573 | A * | 5/2000 | Patel | 434/16 |
| 6,298,764 | B1 * | 10/2001 | Sherman et al. | 89/14.2 |
| 6,615,702 | B1 * | 9/2003 | Julien | 89/16 |
| 6,851,348 | B1 * | 2/2005 | Ang | 89/26 |
| 6,912,945 | B2 * | 7/2005 | Ang | 89/37.05 |
| 7,182,014 | B2 * | 2/2007 | Smith | 89/16 |
| 7,421,934 | B1 * | 9/2008 | Madulka et al. | 89/29 |
| 7,601,232 | B2 * | 10/2009 | Fonte et al. | 148/670 |
| 7,735,408 | B1 * | 6/2010 | Becker et al. | 89/37.05 |
| 2001/0006018 | A1 * | 7/2001 | Ang | 89/42.01 |
| 2005/0034346 | A1 * | 2/2005 | Smith | 42/76.02 |
| 2006/0288854 | A1 * | 12/2006 | Witherell et al. | 89/14.05 |
| 2007/0221051 | A1 * | 9/2007 | Burkholder et al. | 89/1.35 |
| 2010/0236122 | A1 * | 9/2010 | Fonte | 42/76.1 |

OTHER PUBLICATIONS

Douglas, Richard, et al. Production of Inconel 718 Mortar Tubes By Hydrostatic Extrusion, Watervliet Arsenal, Watervliet, Niew York, Jul. 1974.*

M224 60mm Lightweight Mortar, 1999. http_web.archive.org_web_19991221083851_http_www.biggerhammer.net_factfile.nsf_ffiles_a072707cfe330d3b8525627b006b6e36.pdf.*

M224 60-MM Mortar Basis of Issue Plan, 2000. http_web.archive.org_web_20000530071510_http_www.fas.org_man_dod-101_sys_land_docs_bnl005AA.pdf.*

M224 60mm Lightweight Company Mortar System, 2003. http_web.archive.org_web_20030219151349_http_www.fas.org_man_dod-101_sys_land_m224.pdf.*

National Defense Industrial Association, Picatinny Chapter, vol. 1, Issue V. Nov. 2005. http_www.ndiapicatinny.com_downloads_2005_Nov%2005%20Newsletter.pdf.*

The Voice, 2005. http_www.pica.army.mil_voice_voice2005_051202_051202%20Mortar%20conf.pdf.*

KMI Media Group, 2011.http_www.special-operations-technology.com_component_search_searchword=superalloy&ordering=&searchphrase=all.pdf.*

Kemp, Ian, Infantry: Mortars, Armada International (Accessed at The Free Library.com) Apr. 1, 2006. http_www.thefreelibrary.com_Pocket+artillery.-a0146354592.pdf.*

Patriarca, Michael, Innovation Drives Lightweight Mortar Weapon System Development, USAASC, Jan. 2008. http_www.usaasc.info_alt_online_article.cfm_ilD=0801&aid=10.pdf.*

* cited by examiner

SUPERALLOY MORTAR TUBE

CROSS-REFERENCE TO RELATED APPLICATIONS

This application is a continuation-in-part of U.S. patent application Ser. No. 11/162,745 filed on Sep. 21, 2005, which claims the benefit under 35 USC 119(e) of U.S. provisional patent applications 60/522,510 filed on Oct. 7, 2004 and 60/522,566 filed on Oct. 14, 2004, which applications are hereby incorporated by reference.

STATEMENT OF GOVERNMENT INTEREST

The inventions described herein may be manufactured, used and licensed by or for the U.S. Government for U.S. Government purposes.

BACKGROUND OF THE INVENTION

The invention relates in general to mortar tubes, and in particular to finless mortar tubes with reduced wall thicknesses.

Mortars tubes presently used by the United States armed forces are generally available in three sizes of nominal inside diameter, namely, 60 mm (millimeter), 81 mm and 120 mm. The current 60 mm and 81 mm mortar tubes have cooling fins that function to reduce the tube temperature during firing. The mortar tube cooling fins are expensive to manufacture and add additional weight to the mortar tube. The 120 mm mortar tube does not have cooling fins because its required rate of fire is less than the 60 mm and 81 mm mortars. Lightweight finless mortar tubes in the 60 mm and 81 mm sizes that are capable of firing high pressure rounds at the high rates of fire characteristic of United States mortars are not known.

Generally speaking, the soldier in the field benefits whenever anything he/she must handle is made to weigh less. In "Hydrostatic Extrusion of 60 mm Mortar Tubes" (Watervliet Arsenal, Watervliet, N.Y., October 1974, available from NTIS, Springfield, Va.), DeFries describes the hydrostatic extrusion of four 60 mm tubes made of Inconel, a "superalloy." These tubes were relatively thick-walled (approximately 5 mm or greater) and included cooling fins. Although some mechanical tests were performed on the DeFries tubes, it does not appear that the tubes were ever "live-fire" tested. There is a need for a mortar tube that is light in weight (thin-walled), cheap to manufacture (no cooling fins), and capable of rapid, continuous firing without failure.

SUMMARY OF THE INVENTION

An object of the invention is to provide mortar tubes that are lighter in weight than known mortar tubes.

Another object of the invention is to provide finless mortar tubes in the 60 mm and 81 mm sizes.

A further object of the invention is to provide light-weight, finless mortar tubes that can withstand rapid, continuous firing rates without plastic deformation.

One aspect of the invention is a mortar tube comprising a tube having no cooling fins, made of a superalloy, and having a nominal constant inside diameter of about 60 mm; the tube comprising, seriatim, a breech end, a beginning taper point, an ending taper point, a lower clamp region, an upper clamp region, and a muzzle end; a nominal wall thickness of the tube being constant from forward of the breech end to the beginning taper point and the nominal wall thickness of the tube decreasing from the beginning taper point to the ending taper point; wherein the tube does not undergo plastic deformation when firing 30 rounds per minute for four minutes and 20 rounds per minute continuous thereafter, at a maximum pressure of about 10,080 psi.

Another aspect of the invention is a mortar tube comprising a tube having no cooling fins, made of a superalloy, and having a nominal constant inside diameter of about 81 mm; the tube comprising, seriatim, a breech end, a beginning taper point, an ending taper point, a lower clamp region, an upper clamp region, and a muzzle end; a nominal wall thickness of the tube being constant from forward of the breech end to the beginning taper point and the nominal wall thickness of the tube decreasing from the beginning taper point to the ending taper point; wherein the tube does not undergo plastic deformation when firing 30 rounds per minute for two minutes and 15 rounds per minute continuous thereafter, at a maximum pressure of about 15,800 psi.

Further aspects of the invention are methods of making mortar tubes from superalloys.

The invention will be better understood, and further objects, features, and advantages thereof will become more apparent from the following description of the preferred embodiments, taken in conjunction with the accompanying drawings.

BRIEF DESCRIPTION OF THE DRAWINGS

In the drawings, which are not necessarily to scale, like or corresponding parts are denoted by like or corresponding reference numerals.

DETAILED DESCRIPTION OF THE PREFERRED EMBODIMENTS

The embodiments of the present invention are mortar tubes that do not have the cooling fins of conventional mortar tubes. The inventive mortar tubes are made of a high strength superalloy. Superalloys are known and typically fall into one of three types, iron based, cobalt based and nickel based. In general, the superalloys have material strengths greater than 140 ksi at tube temperatures greater than 1000 degrees Fahrenheit. The use of a higher strength material permits a thinner wall thickness, as compared to conventional tubes. The mortar tubes made according to the invention weigh approximately thirty percent less than conventional mortar tubes.

Many complex, interrelated and often conflicting factors influence the wall thickness of a mortar tube. Through years of work, the inventors have developed tube profiles for 60 mm and 81 mm finless mortar tubes made of a superalloy, such as Inconel 718 Factors considered include, inter alia, interior ballistics, heat transfer, temperature and pressure profiles, amount of charge per round (charge one to charge four), projectile weight, required rate of fire, wearing of the tube thickness, and stresses not induced by firing, for example, impact stresses caused by dropping the tube on the ground and stresses caused by attaching other components to the tube, such as a bipod. Both computer simulations and live firing test methods were used. Another factor that influences the wall thickness is the manufacturing method. Tubes of a given thickness profile may be satisfactorily produced using one manufacturing method, but another manufacturing method may require adjustments to the tube thickness.

Figure 1A:
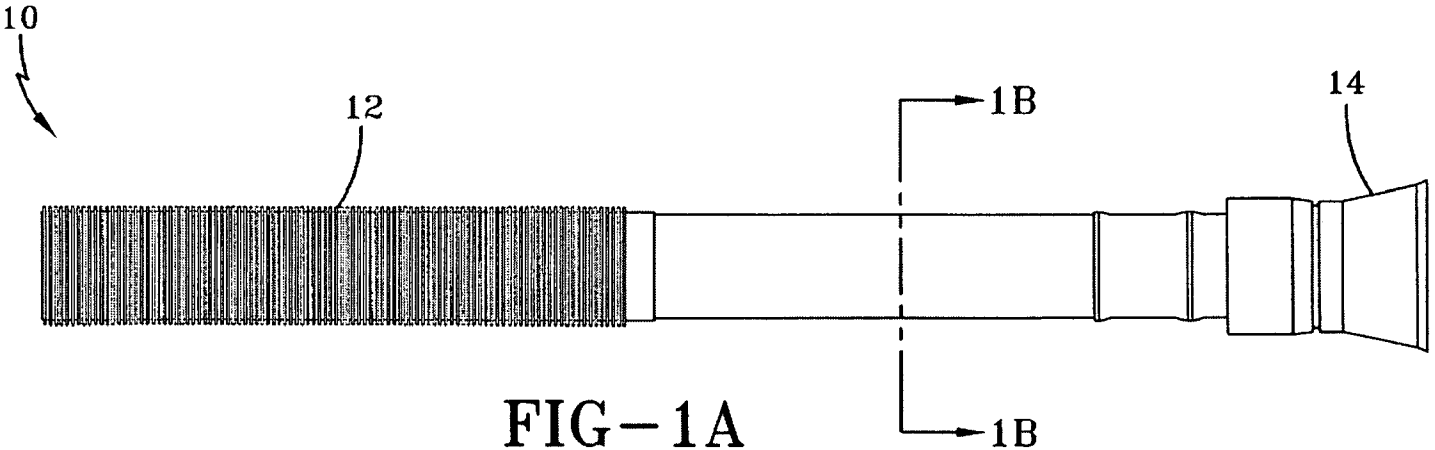
FIG-1A PRIOR ART
FIG. 1A is a side view of a known mortar tube.
Figure 1B:
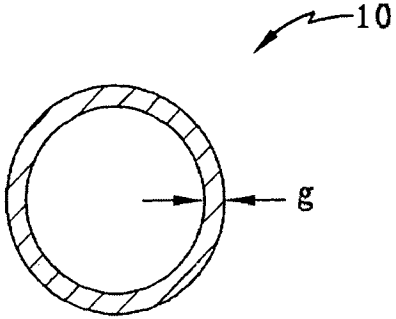
FIG 1B PRIOR ART
FIG. 1B is a sectional view taken along the line 1B-1B of FIG. 1A.

FIG. 1A is a side view of a known 81 mm mortar tube 10 and FIG. 1B is a sectional view of the tube 10 taken along the line 1B-1B of FIG. 1A. Tube 10 includes cooling fins 12 on the rear portion near the breech. A separate blast attenuation device (BAD) 14 is attached at the muzzle end of the tube 10. As seen in FIG. 1B, tube 10 has a wall thickness g. The cooling fins 12 reduce the temperature of the mortar tube 10 from about 1160° F. to 1022° F. at presently required maximum rates of fire, i.e., 30 rounds per minute for 2 minutes and 15 rounds per minute sustained. These rates of fire are based on mortar ammunition having maximum design pressures of 15,800 psi. The steel used to make tube 10 cannot withstand the design ammo pressure loads if the tube temperature increases above 1160° F., as it would if the tube 10 had no cooling fins 12.

The rate of fire (ROF) in number of rounds per minute (rds/min) is an important factor in determining the temperatures that a mortar tube will experience. The higher the ROF number, the higher the temperatures the mortar tube will experience. For an 81 mm finless mortar tube of conventional construction, the maximum ROF is 25 rds/min for 1 minute and 5 rds/min sustained. The conventional tube has a low ROF and is unable to satisfy future requirements for operational use.

In the invention, the performance criteria for the 60 mm and 81 mm tubes involve worst case firing conditions wherein the ambient air temperature is 145 F (63 C) and there is no wind related cooling (a calm day). In accordance with the requirements of STANAG 4110 (A NATO STANardization AGreement for the Definition of Pressure Terms and Their Interrelationship for Use in the Design and Proof of Cannons or Mortars and Ammunition), the mortar tube must be able to function within its design requirements without undergoing plastic deformation when firing a 1 in a million max pressure.

The ROF for the inventive 60 mm tube is 30 rounds per minute for 4 minutes and 20 rounds per minute continuous thereafter. The 60 mm round is a charge four round with a 3 lbm projectile. The one in a million pressure for the 60 mm tube is 10,080 psi. For the 60 mm tube, the hottest temperature occurs during the first 4 minutes when the barrel is being fired at 30 rpm.

The ROF for the inventive 81 mm tube is 30 rounds per minute for 2 minutes and 15 rounds per minute continuous thereafter. The 81 mm round is a charge four round with a 9 lbm projectile. The one in a million pressure for the 81 mm tube is 15,800 psi. For the 81 mm tube, the hottest temperature is reached during the sustained firing period at 15 rpm.

Figure 2:
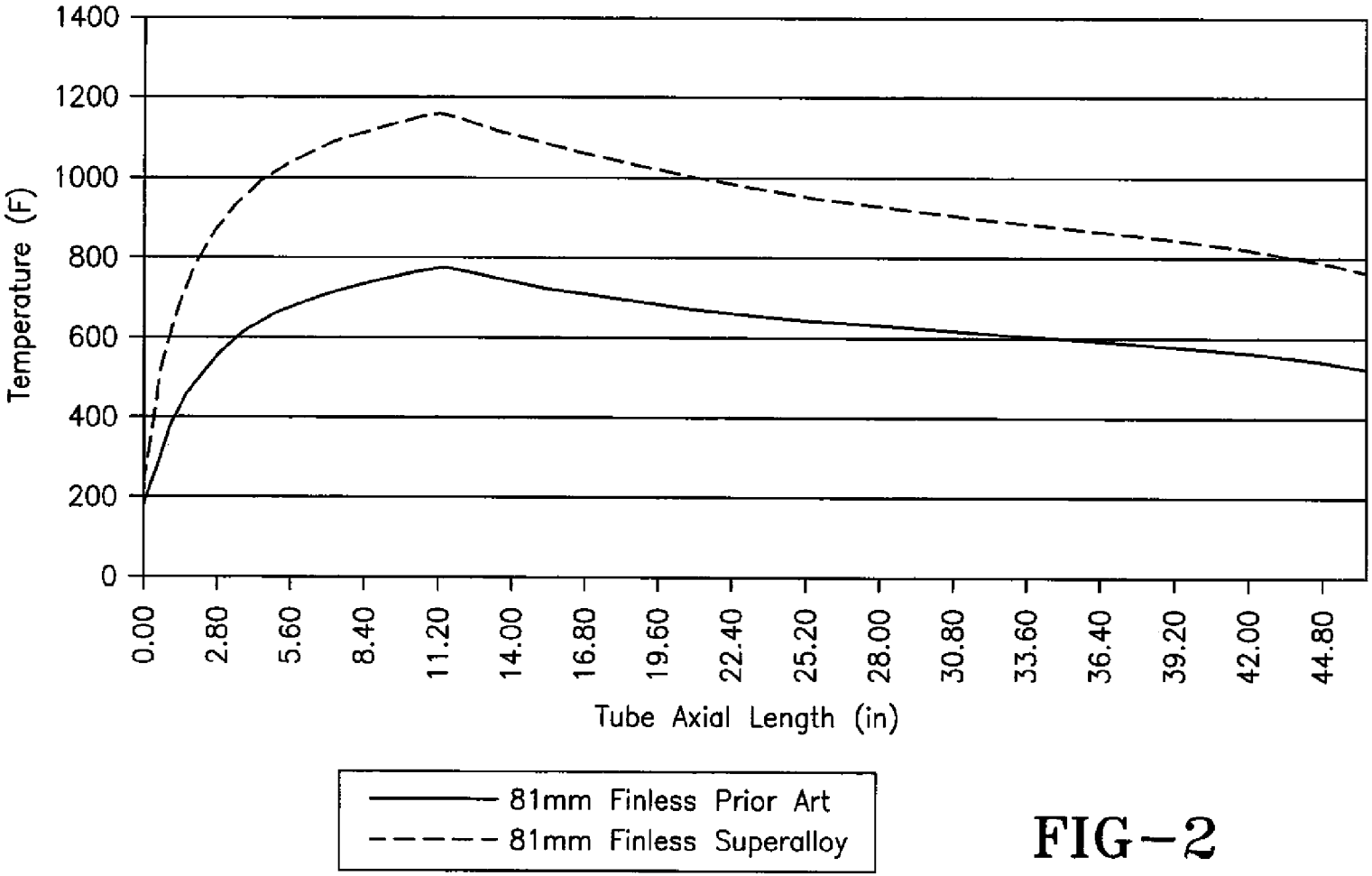
FIG. 2 is a graph of tube temperature vs. axial position for two finless tubes.

FIG. 2 graphically shows temperature profile vs. axial position in the tube for a conventional 81 mm tube (lower curve) and the inventive 81 mm tube (upper curve) at each tube's maximum permissible ROF. The inventive tube's temperature is approximately 400° F. hotter, because of the ability to handle a larger ROF. The conventional mortar tube cannot handle an increased ROF, as needed to meet future requirements, without adding cooling fins.

Figure 3:
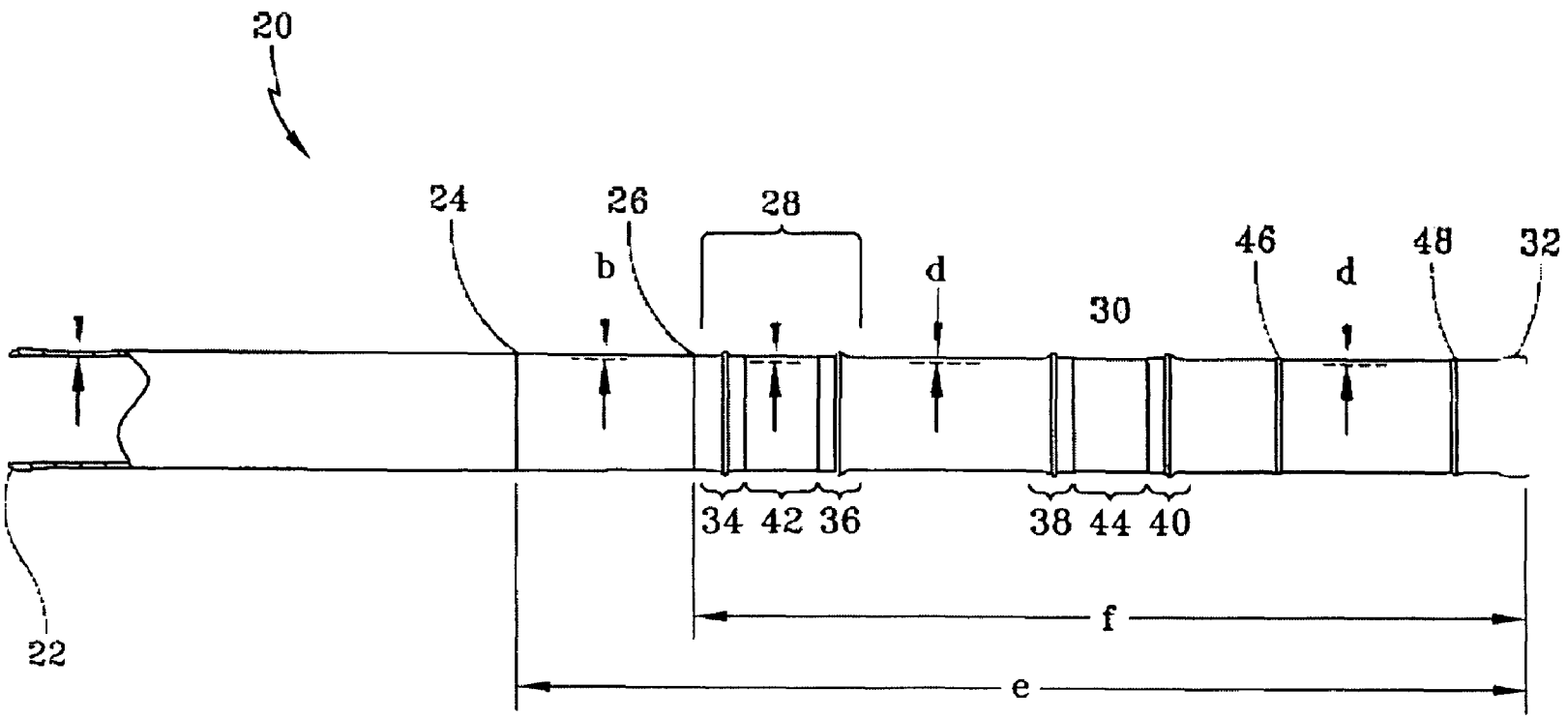
FIG. 3 is a side view, partially in section, of one embodiment of a 60 mm tube in accordance with the invention.

FIG. 3 is a side view, partially in section, of one embodiment of a 60 mm mortar tube 20 in accordance with the invention. Tube 20 has no cooling fins and is made of a superalloy. The superalloy may be one of nickel based, iron based or cobalt based. An example of a nickel based superalloy is Inconel.

Tube 20 has a nominal constant inside diameter of about 60 mm. Tube 20 includes a breech end 22, a beginning taper point 24, an ending taper point 26, a lower clamp region 28, an upper clamp region 30, and a muzzle end 32. In the embodiment of FIG. 3, a separate base cap (not shown) is attached to breech end 22. However, the breech end may also be manufactured with an integral base cap. Tube 20 does not undergo plastic deformation when firing 30 rounds per minute for four minutes and 20 rounds per minute continuous thereafter, the rounds being charge four rounds with projectiles of three lbm. Tube 20 will perform as stated for at least 10,000 rounds.

The nominal wall thickness a of the tube 20 is constant from forward of the breech end 22 to the beginning taper point 24. The nominal constant wall thickness a is in a range of about 2.6 mm to about 3 mm and more preferably in a range of about 2.6 mm to about 2.83 mm.

The nominal wall thickness b of the tube 20 decreases from the beginning taper point 24 to the ending taper point 26. The taper of the outside surface of the tube 20 from the beginning taper point 24 to the ending taper point 26 is in a range of about −0.44 degrees to about −0.55 degrees and more preferably in a range of about −0.47 degrees to about −0.51 degrees. In one embodiment, the nominal wall thickness at the beginning taper point is about 2.6 mm and the nominal wall thickness at the ending taper point is about 1.67 mm. In another embodiment, the nominal wall thickness at the beginning taper point is about 2.83 mm and the nominal wall thickness at the ending taper point is about 1.97 mm.

The distance e from the muzzle end 32 to the beginning taper point 24 is in a range of about 590 mm to about 600 mm. The distance f from the muzzle end 32 to the ending taper point 26 is in a range of about 485 mm to about 495 mm. In a preferred embodiment, the distance e is about 594 mm and the distance f is about 490 mm.

The nominal wall thickness c may be constant from the ending taper point 26 to aft of the lower clamp region 28. The nominal constant wall thickness c from the ending taper point 26 to aft of the lower clamp region 28 may be in a range of about 1.67 mm to about 1.97 mm.

The nominal wall thickness d from the lower clamp region 28 to the upper clamp region 30 and from the upper clamp region 30 to the muzzle end 32 may be constant. The nominal constant wall thickness d may be in a range of about 1.5 mm to about 2 mm. In one embodiment, the constant nominal wall thickness d is about 1.55 mm.

The edges 34, 36, 38, 40 of the lower and upper clamp regions 28, 30 have wall thicknesses that are greater than the adjacent nominal wall thicknesses. The wall thickness of the central area 42 of lower clamp region 28 may be about 1.85 mm. The wall thickness of the central area 44 of the upper clamp region 30 may be about 1.55 mm. Other areas of increased wall thickness include the muzzle end 32, the breech end 22 and rings 46, 48. Rings 46, 48 may be used to locate and contain a steel band (not shown) used to arm a projectile.

Tube 20 may be formed by, for example, forging and machining, or a metal flow-forming process. In general, if the tube 20 is forged and machined, the thinner wall thicknesses may be used. If the tube 20 is flow-formed, then the thicker wall thicknesses may be used.

Figure 4:
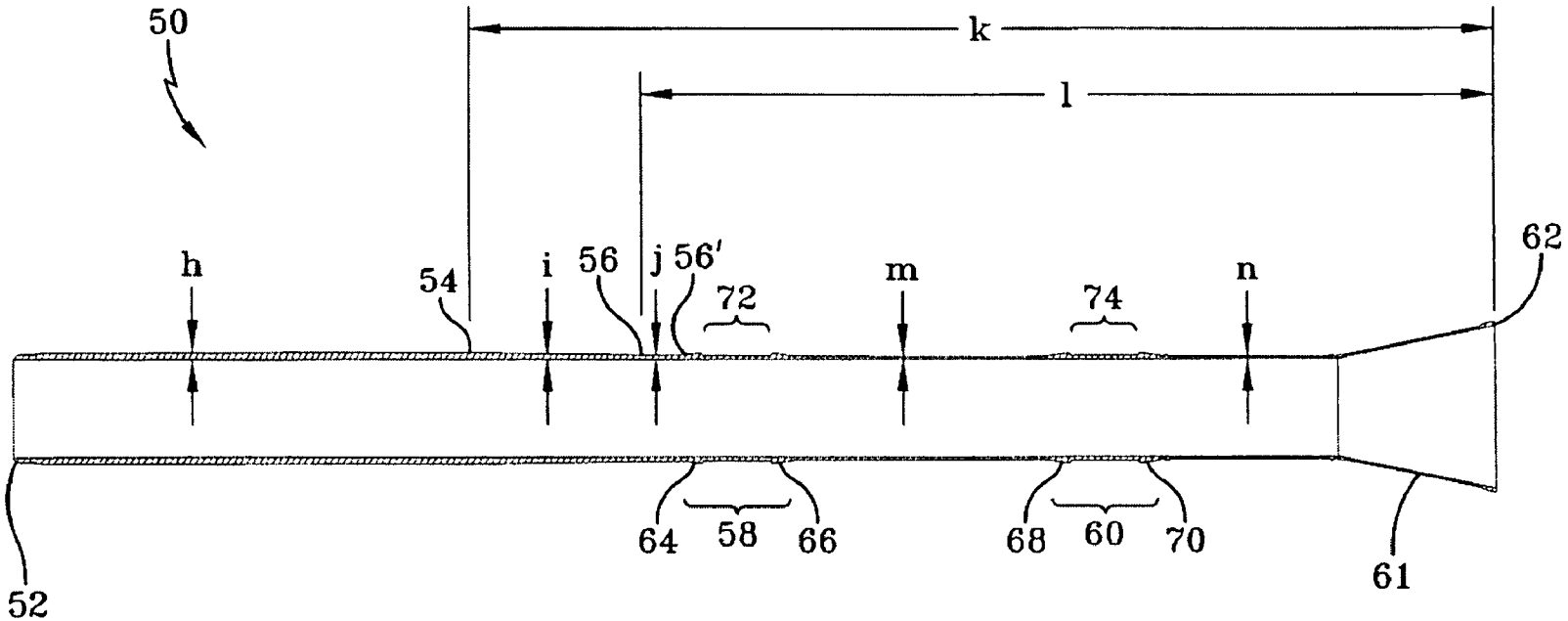
FIG. 4 is a side view, partially in section, of one embodiment of an 81 mm tube in accordance with the invention.

FIG. 4 is a side view, partially in section, of one embodiment of an 81 mm mortar tube 50 in accordance with the invention. Tube 50 has no cooling fins and is made of a superalloy. The superalloy may be one of nickel based, iron based or cobalt based. An example of a nickel based superalloy is Inconel.

Tube 50 has a nominal constant inside diameter of about 81 mm. Tube 50 includes a breech end 52, a beginning taper point 54, ending taper points 56 and 56', a lower clamp region 58, an upper clamp region 60, a blast attenuation device 61, and a muzzle end 62. In the embodiment of FIG. 4, a separate base cap (not shown) is attached to breech end 52. However, the breech end may also be manufactured with an integral base cap. Tube 50 does not undergo plastic deformation when firing 30 rounds per minute for two minutes and 15 rounds per minute continuous thereafter, the rounds being charge four rounds with projectiles of nine lbm. Tube 50 will perform as stated for at least 10,000 rounds.

The nominal wall thickness h of the tube 50 is constant from forward of the breech end 52 to the beginning taper point 54. The nominal constant wall thickness h is in a range of about 4.97 mm to about 5.7 mm and more preferably in a range of about 4.97 mm to about 5.42 mm.

The nominal wall thickness i of the tube 50 decreases from the beginning taper point 54 to the ending taper point 56 or 56'. The taper of the outside surface of the tube 50 from the beginning taper point 54 to the ending taper point 56 or 56' is in a range of about −0.60 degrees to about −0.90 degrees and preferably in a range of about −0.70 degrees to about −0.83 degrees.

In one embodiment, the nominal wall thickness at the beginning taper point 54 is about 4.97 mm and the nominal wall thickness at the ending taper point 56' is about 2.8 mm. In another embodiment, the nominal wall thickness at the beginning taper point 54 is about 5.42 mm and the nominal wall thickness at the ending taper point 56 is about 3.26 mm.

The distance k from the muzzle end 62 to the beginning taper point 54 is in a range of about 880 mm to about 890 mm from the muzzle end 62. Preferably, the distance k is about 886 mm. In one embodiment, the ending taper point 56' is just aft of the lower clamp region 58. In another embodiment, the distance l from the muzzle end 62 to the ending taper point 56 is in the range of about 730 mm to about 740 mm and the nominal constant wall thickness j from the ending taper point 56 to the lower clamp region 58 is in a range of about 3.24 mm to about 3.28 mm. Preferably, the distance l is about 737 mm.

The nominal wall thickness m decreases from the lower clamp region 58 to the upper clamp region 60. The taper of the outside surface of the tube 50 from the lower clamp region 58 to the upper clamp region 60 may be in a range of about −0.13 degrees to about 0.17 degrees. In one embodiment, the nominal wall thickness m decreases from about 2.1 mm forward of the lower clamp region 58 to about 1.61 mm aft of the upper clamp region 60. In another embodiment, the nominal wall thickness m decreases from about 2.21 mm forward of the lower clamp region 58 to about 1.71 mm aft of the upper clamp region 60.

A constant nominal wall thickness n from the upper clamp region 60 to aft of the blast attenuation device 61 may be in a range of about 1.6 mm to about 1.9 mm. Preferably, the constant nominal wall thickness n from the upper clamp region 60 to aft of the blast attenuation device 61 is about 1.63 mm.

The edges 64, 66, 68, 70 of the lower and upper clamp regions 58, 60 have wall thicknesses that are greater than the adjacent nominal wall thicknesses. The wall thickness of the central area 72 of lower clamp region 58 may be about 2.55 mm. The wall thickness of the central area 74 of the upper clamp region 60 may be about 2.55 mm. Other areas of increased wall thickness include the muzzle end 62 and the breech end 52.

Tube 50 may be formed by, for example, forging and machining, or a metal flow-forming process. In general, if the tube 50 is forged and machined, the thinner wall thicknesses may be used. If the tube 50 is flow-formed, then the thicker wall thicknesses may be used. Whether forged and machined, flow-formed or made with some other technique, the blast attenuation device 61 is formed integrally with the tube 50. In the past, the device 61 was a separate component that had to be added to the tube 50 after manufacture. Adding the device 61 to the tube 50 after manufacture was a costly process.

While the invention has been described with reference to certain preferred embodiments, numerous changes, alterations and modifications to the described embodiments are possible without departing from the spirit and scope of the invention as defined in the appended claims, and equivalents thereof.

What is claimed is:

1. A mortar tube, comprising:

a tube having no cooling fins, made of a superalloy, and having a nominal constant inside diameter of about 60 mm;

the tube comprising, seriatim, a breech end, a beginning taper point, an ending taper point, a lower clamp region, an upper clamp region, and a muzzle end;

a nominal wall thickness of the tube being constant from forward of the breech end to the beginning taper point and the nominal wall thickness of the tube decreasing from the beginning taper point to the ending taper point;

wherein the tube does not undergo plastic deformation when firing 30 rounds per minute for four minutes and 20 rounds per minute continuous thereafter, at a maximum pressure of about 10,080 psi.

2. The mortar tube of claim 1 wherein the nominal constant wall thickness from forward of the breech end to the beginning taper point is in a range of about 2.6 mm to about 3 mm.

3. The mortar tube of claim 2 wherein the nominal constant wall thickness from forward of the breech end to the beginning taper point is in a range of about 2.6 mm to about 2.83 mm.

4. The mortar tube of claim 1 wherein a taper of an outside surface of the tube from the beginning taper point to the ending taper point is in a range of about −0.44 degrees to about −0.55 degrees.

5. The mortar tube of claim 4 wherein the taper of the outside surface of the tube from the beginning taper point to the ending taper point is in a range of about −0.47 degrees to about −0.51 degrees.

6. The mortar tube of claim 1 wherein the nominal wall thickness is constant from the ending taper point to aft of the lower clamp region.

7. The mortar tube of claim 6 wherein the nominal constant wall thickness from the ending taper point to aft of the lower clamp region is in a range of about 1.67 mm to about 1.97 mm.

8. The mortar tube of claim 1 wherein the nominal wall thickness at the beginning taper point is about 2.6 mm and the nominal wall thickness at the ending taper point is about 1.67 mm.

9. The mortar tube of claim 1 wherein the nominal wall thickness at the beginning taper point is about 2.83 mm and the nominal wall thickness at the ending taper point is about 1.97 mm.

10. The mortar tube of claim 1 wherein the nominal wall thickness from the lower clamp region to the upper clamp region and from the upper clamp region to the muzzle end is constant.

11. The mortar tube of claim 10 wherein the constant nominal wall thickness from the lower clamp region to the upper clamp region and from the upper clamp region to the muzzle end is in a range of about 1.5 mm to about 2 mm.

12. The mortar tube of claim 11 wherein the constant nominal wall thickness from the lower clamp region to the upper clamp region and from the upper clamp region to the muzzle end is about 1.55 mm.

13. The mortar tube of claim 1 wherein the beginning taper point is in a range of about 590 mm to about 600 mm from the muzzle end of the tube and the ending taper point is in a range of about 485 to about 495 mm from the muzzle end.

14. The mortar tube of claim 13 wherein the beginning taper point is about 594 mm from the muzzle end of the tube and the ending taper point is about 490 mm from the muzzle end.

15. A mortar tube, comprising:

a tube having no cooling fins, made of a superalloy, and having a nominal constant inside diameter of about 81 mm;

the tube comprising, seriatim, a breech end, a beginning taper point, an ending taper point, a lower clamp region, an upper clamp region, and a muzzle end;

a nominal wall thickness of the tube being constant from forward of the breech end to the beginning taper point and the nominal wall thickness of the tube decreasing from the beginning taper point to the ending taper point;

wherein the tube does not undergo plastic deformation when firing 30 rounds per minute for two minutes and 15 rounds per minute continuous thereafter, at a maximum pressure of about 15,800 psi.

16. The mortar tube of claim 15 wherein the nominal constant wall thickness from forward of the breech end to the beginning taper point is in a range of about 4.97 mm to about 5.7 mm.

17. The mortar tube of claim 16 wherein the nominal constant wall thickness from forward of the breech end to the beginning taper point is in a range of about 4.97 mm to about 5.42 mm.

18. The mortar tube of claim 15 wherein a taper of an outside surface of the tube from the beginning taper point to the ending taper point is in a range of about −0.60 degrees to about −0.90 degrees.

19. The mortar tube of claim 18 wherein the taper of the outside surface of the tube from the beginning taper point to the ending taper point is in a range of about −0.70 degrees to about −0.83 degrees.

20. The mortar tube of claim 15 wherein the nominal wall thickness at the beginning taper point is about 4.97 mm and the nominal wall thickness at the ending taper point is about 2.8 mm.

21. The mortar tube of claim 15 wherein the nominal wall thickness at the beginning taper point is about 5.42 mm and the nominal wall thickness at the ending taper point is about 3.26 mm.

22. The mortar tube of claim 15 wherein the beginning taper point is a range of about 880 mm to about 890 mm from the muzzle end.

23. The mortar tube of claim 15 wherein the ending taper point is at an aft end of the lower clamp region.

24. The mortar tube of claim 15 wherein the ending taper point is in the range of about 730 mm to about 740 mm from the muzzle end and the nominal constant wall thickness from the ending taper point to the lower clamp region is in a range of about 3.24 mm to about 3.28 mm.

25. The mortar tube of claim 15 wherein the nominal wall thickness decreases from the lower clamp region to the upper clamp region.

26. The mortar tube of claim 25 wherein a taper of an outside surface of the tube from the lower clamp region to the upper clamp region is in a range of about −0.13 degrees to about −0.17 degrees.

27. The mortar tube of claim 25 wherein the nominal wall thickness decreases from about 2.11 mm forward of the lower clamp region to about 1.61 mm aft of the upper clamp region.

28. The mortar tube of claim 25 wherein the nominal wall thickness decreases from about 2.21 mm forward of the lower clamp region to about 1.71 mm aft of the upper clamp region.

29. The mortar tube of claim 15 further comprising a blast attenuation device at the muzzle end and wherein a constant nominal wall thickness from the upper clamp region to aft of the blast attenuation device is a range of about 1.6 mm to about 1.9 mm.

30. The mortar tube of claim 29 wherein the constant nominal wall thickness from the upper clamp region to aft of the blast attenuation device is about 1.63 mm.

31. A method of making a mortar tube, comprising:

providing a superalloy material; and making the mortar tube of claim 1 from the superalloy material.

32. A method of making a mortar tube, comprising:

providing a superalloy material; and making the mortar tube of claim 15 from the superalloy material.

33. The method of claim 32 wherein the making step includes forming a blast attenuation device integral with the mortar tube.

* * * * *